US005209017A

United States Patent [19]

Ridge

[11] Patent Number: 5,209,017

[45] Date of Patent: May 11, 1993

[54] PRE-HUNG DOOR RETAINING DEVICE

[76] Inventor: Jimmy D. Ridge, Rte. 4, Box 851, High Point, N.C. 27263

[21] Appl. No.: 828,007

[22] Filed: Jan. 30, 1992

[51] Int. Cl.[5] ..... E06B 1/00

[52] U.S. Cl. ..... 49/380; 206/325

[58] Field of Search ..... 49/380, 503, 504; 206/321, 325; 403/403

[56] References Cited

U.S. PATENT DOCUMENTS

D. 319,007 8/1991 Rogers et al. ..... 8/400

4,483,101 11/1984 Berzina ..... 49/380

*Primary Examiner*—Peter M. Cuomo

*Assistant Examiner*—Jerry Rodman

[57] ABSTRACT

A relatively rigid polymeric retaining device is provided for attachment to a pre-hung door assembly. The device includes a planar surface for placement against the door face and includes a cylindrical insert for placement within the hardware bore or opening. A stabilizer is attached perpendicularly to the device for assisting in spacing and holding the door in a fixed position relative to the frame. The retaining device is attached by small staples or the like and once the door is installed in a wall the device can easily be removed without damage to the door or frame.

14 Claims, 2 Drawing Sheets

PRE-HUNG DOOR RETAINING DEVICE

BACKGROUND OF THE INVENTION

1. Field Of The Invention

The invention herein pertains to the manufacture of door assemblies and particularly to the manufacture of assemblies having pre-hung doors hingedly joined to the frame. A releasable, disposable retainer is provided to maintain the door within the frame during shipment and installation in a wall opening afterwhich the retainer is removed and handle hardware is incorporated.

2. Description Of The Prior Art And Objectives Of The Invention

Pre-hung door assemblies are conventionally manufactured and distributed by building product suppliers as an expedient and convenience to carpenters and workers that install doors into "rough" wall openings. It is common activity in the building trade to purchase pre-hung, hinged door assemblies which can be quickly installed in wall openings during building and remodeling. To best maintain the pre-hung doors within the frames, manufacturers usually drive nails through the frame into the edge of the door. These nails are later removed prior to door installation. Nails or comparable fasteners mar the door edge and frame and care must be taken not to further damage the door during removal of the nails. In recent years various devices have been conceived to solve this problem such as the strap mechanism as set forth in U.S. Pat. No. 4,483,101. This device fits within the hardware bore of the door and wraps around the frame. The strap can later be cut and covered with a door casing. Other attempts at providing a temporary retainer can also be found such as set forth in Rogers, et al. U.S. Pat. No. Des. 319,007.

Also, pre-hung door assemblies are conventionally used in most new and remodeling constructions and include a frame of either a one or two piece configuration into which a door is pre-hung by hinges. Trim casing is applied to one side of one piece jambs and two sides of a two piece jamb. During fabrication, nails are usually driven through the back of the lockside jamb and into the edge of the door in order to hold the assembly together during shipment. Once the assembly is to be installed in a rough wall opening, the nails holding the lockside jamb to the door must be removed. The action of removing the nails allows the lock jamb and casing to swing freely relative to the door and the door usually falls slightly downward from the head jamb. This results in a difficult to install plumb and square door assembly and possibly poorly aligned miter joints on the door casing. A need exists for an improved means by which the original fabricator of the pre-hung door assembly can insure an assembly that will remain square and plumb until installed at the job site.

Each of the prior art attempts have provided some benefits over conventional nails, however these devices and others often require a great amount of time and work to apply and remove. Therefore, it is one objective of the present invention to provide a pre-hung door retaining device which will not interfere with the installation of the door yet which can be easily applied or removed while on one side of the door.

It is still another objective of the present invention to provide a pre-hung door retaining device which is inexpensive to produce and which can be easily and conveniently installed by relatively unskilled workers.

It is yet another objective of the present invention to provide a pre-hung door retaining device which will allow a single carpenter to install a pre-hung door and easily remove the retaining device while working from one side.

Various other objectives and advantages of the present invention become apparent to those skilled in the art as a more detailed description is presented below.

SUMMARY OF THE INVENTION

The aforesaid and other advantages and objectives are realized by providing a pre-hung door retaining device which can be formed from a substantially thin, rigid plastic such as polypropylene or the like. The device includes a planar surface for engaging the face of the door and includes a cylindrical insert at one end for fitting within the hardware bore of the door. A stabilizer is positioned at the opposite end of the planar member and is mounted perpendicularly thereto. A pedestal separates the planar member from a casing abutment which fits over and is affixed by fasteners such as small staples through apertures therein to a door casing. Once the pre-hung door is installed in the wall opening, the fasteners can be easily removed from the retaining device and the door handle hardware attached.

DESCRIPTION OF THE PREFERRED EMBODIMENT

Figure 1:
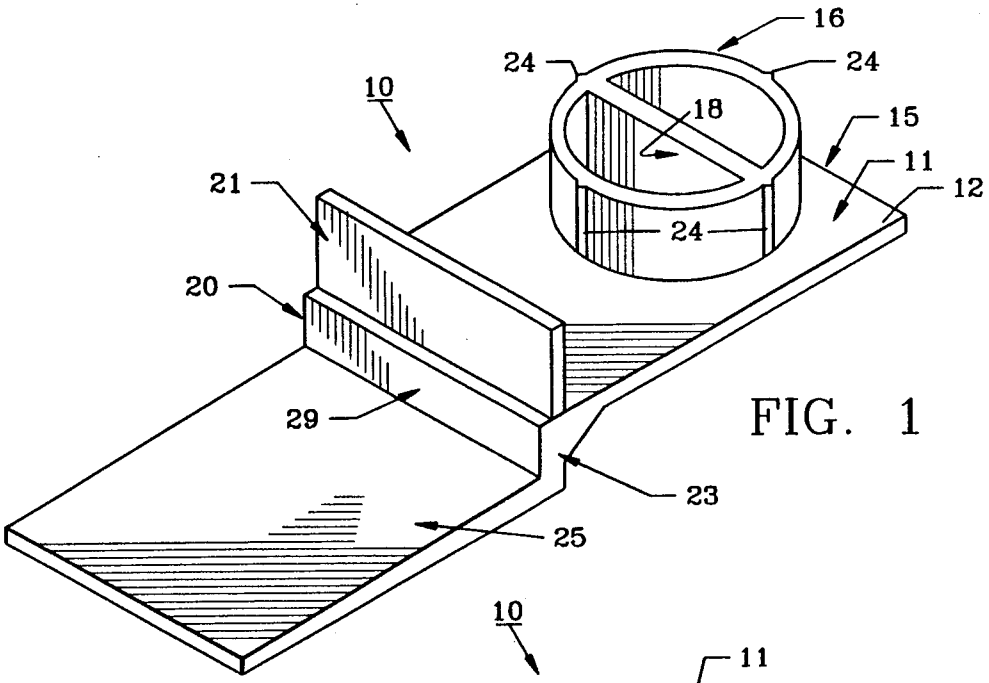
FIG. 1 demonstrates a perspective view of the retaining device of the invention.
Figure 2:
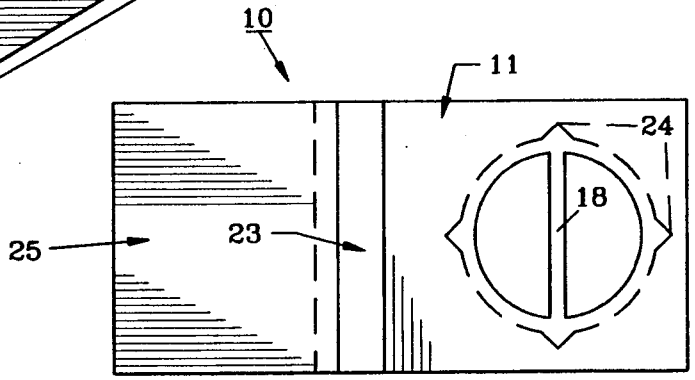
FIG. 2 shows a bottom plan view thereof.

The preferred form of the invention is illustrated in FIGS. 1 and 2 whereby a retaining device is molded from polypropylene or the like. The retaining device as shown includes a substantially rigid planar member and mounted at the terminal end thereof is a cylindrical shaped open ended insert having a brace thereacross. The insert includes a series of elongated projections which help secure the insert within the hardware bore. The insert is positionable within the hardware bore of the door and the brace supports the insert while allowing a worker to easily lift or move the door by inserting his fingers through the cylinder. At the opposite end of the rigid member a perpendicularly mounted stabilizer is shown which fits between the door and the door frame. Below the stabilizer as seen in FIG. 1, a wedge-shaped pedestal gives a stair-step effect to the retaining device and along the bottom of the pedestal a casing abutment is affixed having a series of apertures therein for enclosing and attaching to the door casing.

DETAILED DESCRIPTION OF THE DRAWINGS AND OPERATION OF THE INVENTION

Figure 3:
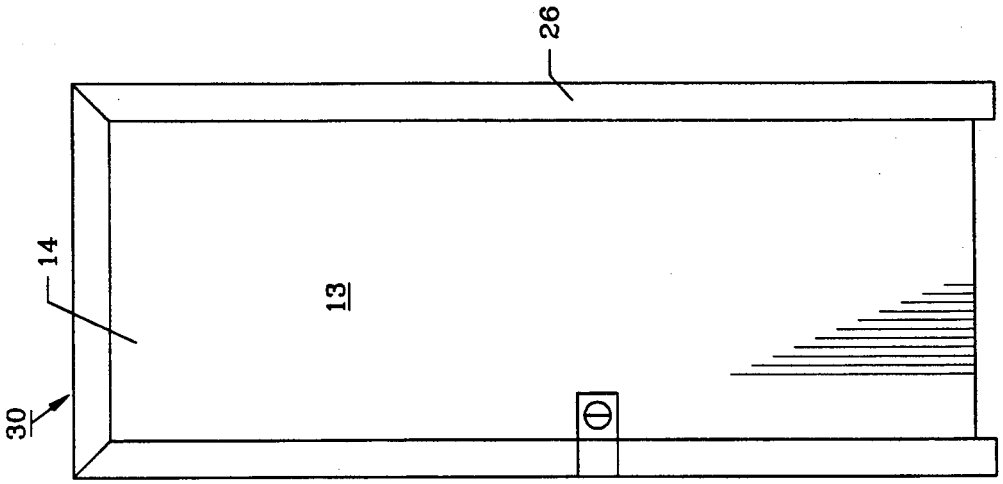
FIG. 3 illustrates a pre-hung door assembly with the retaining device attached thereto.

For a better understanding of the invention and its operation, turning now to the drawings, FIG. 1 illustrates a pre-hung door retainer or device 10 which includes a rigid, planar member 11 having a smooth surface 12 for positioning against a door face such as front face 13 of door 14 as shown in FIG. 3. Affixed at the distal end 15 of planar member 11 is cylindrical insert 16 which acts as a means for inserting into hardware bore 17 of door 14 as seen in FIG. 4A. Cylindrical insert 16 includes a divider 18 which supports insert 16. Along the outer periphery of insert 16 is a plurality of pointed projections 24 which help insert 16 grip the inner, conventional wooden walls of hardware bore 17. At the proximal end 20 of planar member 11 a perpendicularly disposed stabilizer 21 is joined. Stabilizer 21 is placed between the edge of door 14 and door frame 22 to space the same as shown in FIG. 4A and maintains device 10 in its correct position when attached to door 14. Device 10 is relatively thin and rigid and is formed from a suitable stiff polymeric material such as polypropylene or other plastics or materials having the structural stability and integrity for its intended purposes.

A substantially wedge-shaped pedestal 23 is located at the proximal end 20 of planar member 11 and is disposed between casing abutment 25 and planar member 11. In use, abutment 25 is positioned over door frame casing 26 as shown in FIG. 4A and acts as a means to engage front casing 26. Small staples or fasteners 27 can be positioned as seen to maintain device 10 in place during installation of frame 22 into the wall opening. As would be understood, staples 27 and cylindrical insert 16 combine to secure device 10 on pre-hung door 14 before and during installation of door assembly 30.

As further shown in FIGS. 1 and 2, rigid planar member 11 is in substantial parallel alignment with casing abutment 25 with wedge-shaped pedestal 23 having vertical face 29 being disposed therebetween to provide a stair-step effect to match certain of the contours of door assembly 30.

In use, pre-hung door assembly 30 is usually manufactured with door 14 as seen in FIG. 3 being hingedly joined to door frame 22 (FIG. 4A). Since door 14 is hingedly joined and is without door handle hardware, door 14 is free to move and must be temporarily secured to prevent damage and to increase the convenience to the carpenters performing the door installation. By inserting cylindrical appendage 16 into hardware bore 17 of door 14, projections 24 slightly penetrate the inner bore walls and small staple fasteners 27 or the like can then be secured through pedestal 23 and abutment 25. So affixed, device 10 then provides a stable, convenient, temporary door retainer which is quite easy to remove without damage to the door, frame casement or the like. Door 14 itself has no unsightly nail or fastener holes which must be filled and painted or varnished after installation.

Figure 4B:
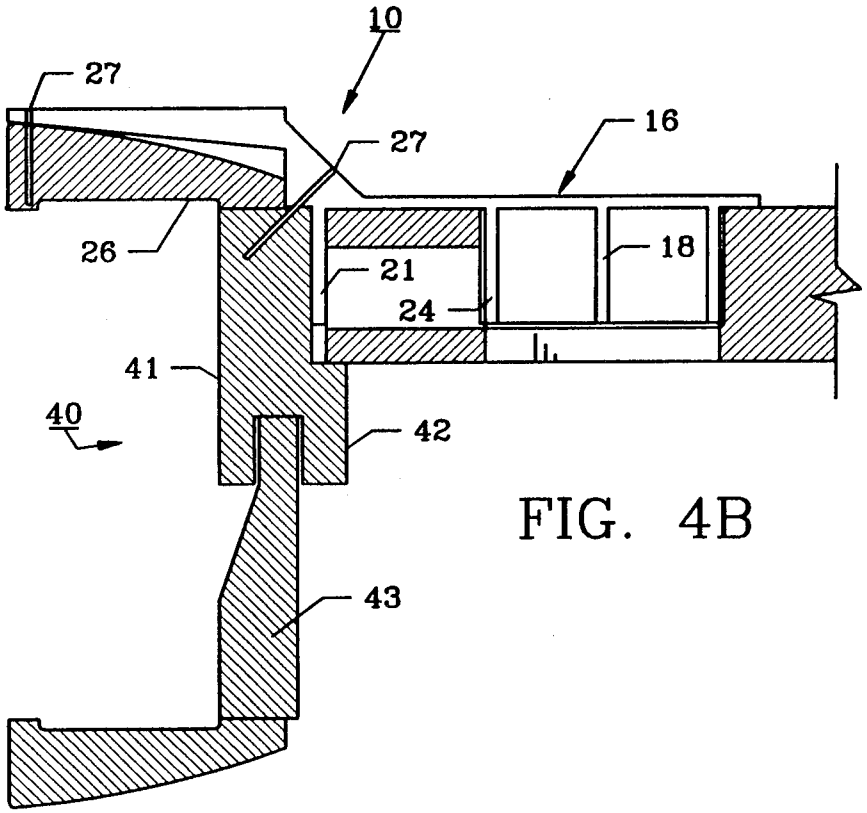
FIG. 4B illustrates a two part door frame assembly with the invention thereon.
Figure 4A:
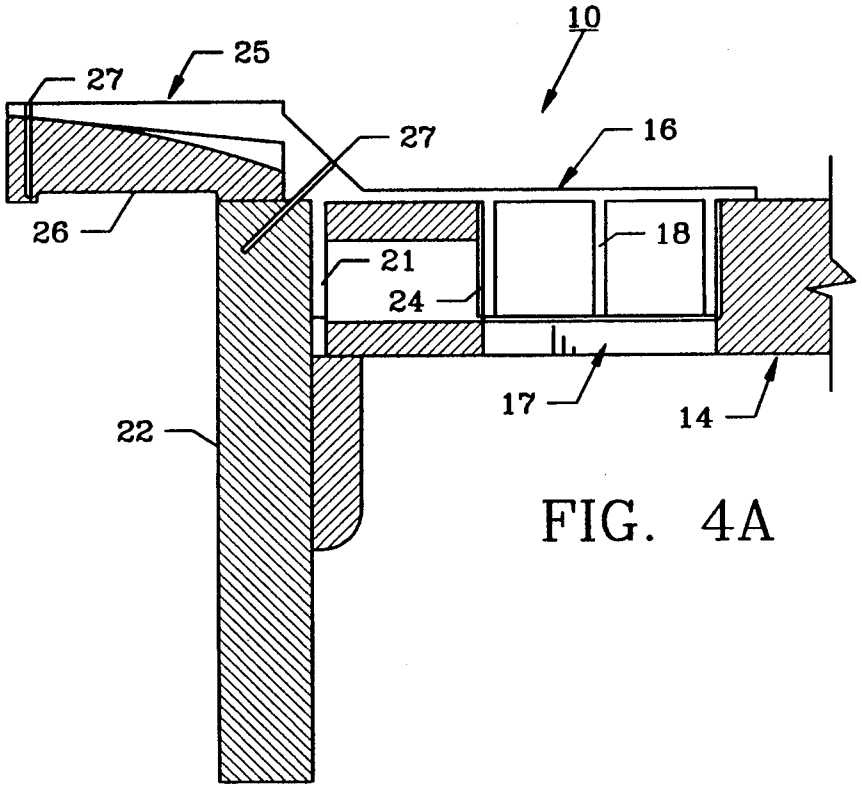
FIG. 4A shows a cross-sectional view of a typical one piece door frame assembly with the invention thereon.

Another type of conventional door assembly 40 is shown in FIG. 4B whereby frame 41 is manufactured in two parts (42 and 43) and can be separated prior to door installation. Device 10 works equally well with assembly 40.

The illustrations and examples provided herein are for explanatory purposes and are not intended to limit the scope of the appended claims.

I claim:

1. A door retaining device for use with a door having front and rear faces and with a hardware opening comprising: a rigid member for positioning against a door face, an inserting means for inserting into the door hardware opening, said inserting means attached to said rigid member, a door frame and a stabilizing means to stabilize said door, said stabilizing means affixed to said rigid member and positioned between said door and said door frame, and said device being attached to said door frame.

2. A door retaining device as claimed in claim 1 wherein said rigid member comprises a planar surface.

3. A door retaining device as claimed in claim 1 wherein said inserting means comprises a cylindrical configuration.

4. A door retaining device as claimed in claim 1 wherein said stabilizing means extends perpendicularly from said rigid member.

5. A door retaining device as claimed in claim 1 and including a pedestal, said pedestal positioned on said rigid member.

6. A door retaining device as claimed in claim 1 wherein said inserting means comprises a cylinder, a gripping means to grip said cylinder, said gripping means joined to said cylinder.

7. A door retaining device as claimed in claim 5 wherein said pedestal is wedge-shaped.

8. A device to temporarily retain a pre-hung hinged door in a door frame during installation of the door frame in a wall, said door having front and rear faces, a casing, said casing attached to said frame, and said door defining a hardware opening, said device comprising: a rigid member for placement against one of said door faces, an inserting means for inserting into said hardware opening, said inserting means joined to said rigid member, and a casing engaging means to engage said a door stabilizing means to stabilize said door, said stabilizing means attached to said rigid member for positioning between said door and said door frame, and said device being attached to said door frame casing, said casing engaging means affixed to said rigid member.

9. A door retaining device as claimed in claim 8 wherein said inserting means comprises an open ended cylinder, a gripping means to grip said cylinder, said gripping means attached to said cylinder and spanning the hardware opening end thereof.

10. A door retaining device as claimed in claim 8 wherein said device is formed from a polymeric material.

11. A door retaining device as claimed in claim 8 wherein said casing engaging means is in parallel alignment with said rigid member.

12. A door retaining device as claimed in claim 8 wherein said door stabilizing means is perpendicularly aligned with said rigid member.

13. A door retaining device as claimed in claim 8 and including a pedestal, said pedestal positioned between said rigid member and said casing engaging means.

14. A door retaining device as claimed in claim 8 and including an insert divider, said divider affixed within said inserting means.

* * * * *